US005626043A

United States Patent [19]

Bogart et al.

[11] Patent Number: 5,626,043

[45] Date of Patent: May 6, 1997

[54] APPARATUS FOR FORMING CURVED RECTANGULAR BODIED NEEDLES

[75] Inventors: Michael W. Bogart, Milford; Richard J. Smith, Stamford, both of Conn.

[73] Assignee: United States Surgical Corporation, Norwalk, Conn.

[21] Appl. No.: 602,227

[22] Filed: Feb. 15, 1996

Related U.S. Application Data

[60] Division of Ser. No. 135,602, Oct. 8, 1993, Pat. No. 5,526,666, which is a continuation-in-part of Ser. No. 958,926, Oct. 9, 1992, abandoned.

[51] Int. Cl.[6] ..... B21G 1/00

[52] U.S. Cl. ..... 72/133; 163/5

[58] Field of Search ..... 72/377, 133, 381, 72/383, 384, 394, 399, 400, 401, 403; 163/1, 5

[56] References Cited

U.S. PATENT DOCUMENTS

| | | | |
|---|---|---|---|
| 1,697,896 | 1/1929 | Yates | 72/167 |
| 2,009,287 | 7/1935 | Baxter et al. | 163/1 |
| 2,309,963 | 2/1943 | Krueger | 72/133 |
| 2,756,803 | 7/1956 | Faeber | 72/166 |
| 2,990,001 | 6/1961 | Hansen | 72/166 |
| 3,040,798 | 6/1962 | Johnson | 72/172 |
| 3,112,087 | 11/1963 | Fornataro | 72/166 |
| 3,357,222 | 12/1967 | Konstandt | 72/146 |
| 3,556,953 | 1/1971 | Schulz | 163/1 |
| 3,994,656 | 11/1976 | Van Ausdall | 72/178 |
| 4,063,442 | 12/1977 | Martin, Sr. | 72/166 |
| 4,524,771 | 6/1985 | McGregor et al. | 606/223 |
| 4,890,614 | 1/1990 | Kawada et al. | 163/1 |
| 5,041,127 | 8/1991 | Troutman | 606/223 |
| 5,287,721 | 2/1994 | Samsel | 72/400 |
| 5,323,633 | 6/1994 | Bogart et al. | 163/1 |
| 5,330,441 | 7/1994 | Prasad et al. | 606/222 |
| 5,351,518 | 10/1994 | Bogart et al. | 163/1 |

FOREIGN PATENT DOCUMENTS

| | | |
|---|---|---|
| 0286483 | 4/1988 | European Pat. Off. . |
| 63-73989 | 4/1988 | Japan . |
| 63-309338 | 12/1988 | Japan . |
| 01138030 | 5/1989 | Japan . |
| 54818 | 6/1942 | Netherlands . |

*Primary Examiner*—Lowell A. Larson
*Assistant Examiner*—Thomas C. Schoeffler

[57] ABSTRACT

An apparatus for forming at least one curved, rectangular bodied surgical needle which comprises frame means, flat press means associated with said frame means for imparting first flat surfaces to opposite sides of at least a portion of at least one needle blank, curving means associated with said frame means for imparting an arcuate profile to at least a portion of the at least one needle blank and side press means mounted on said frame portion for imparting second flat surfaces to opposite sides of the needle blank, wherein said second flat surfaces are imparted substantially perpendicular to said first flat surfaces. There is also disclosed a method of forming a curved rectangular bodied needle from a substantially round-elongated needle blank comprising the steps of flat pressing opposite sides of the needle blanks between a pair of flat press dies, drawing the needle blanks from at least one of said flat press dies onto a rotatable mandrel, curving the needle blanks between said rotatable mandrel and a reciprocable belt, rotating the needle blanks adjacent side press dies and depositing the needle blanks therebetween and side pressing opposite sides of the needle blanks between said side press dies, on sides of the needle blanks substantially perpendicular to the flat pressed sides. A surgical needle is also disclosed having a tapered distal portion, a rectangular central portion and a bored proximal portion formed according to the apparatus and method described above. The tapered distal portion of the needle has a generally circular cross-section, the rectangular central portion is generally square and the bored proximal portion also has a generally circular cross-section.

4 Claims, 11 Drawing Sheets

FIG. 5
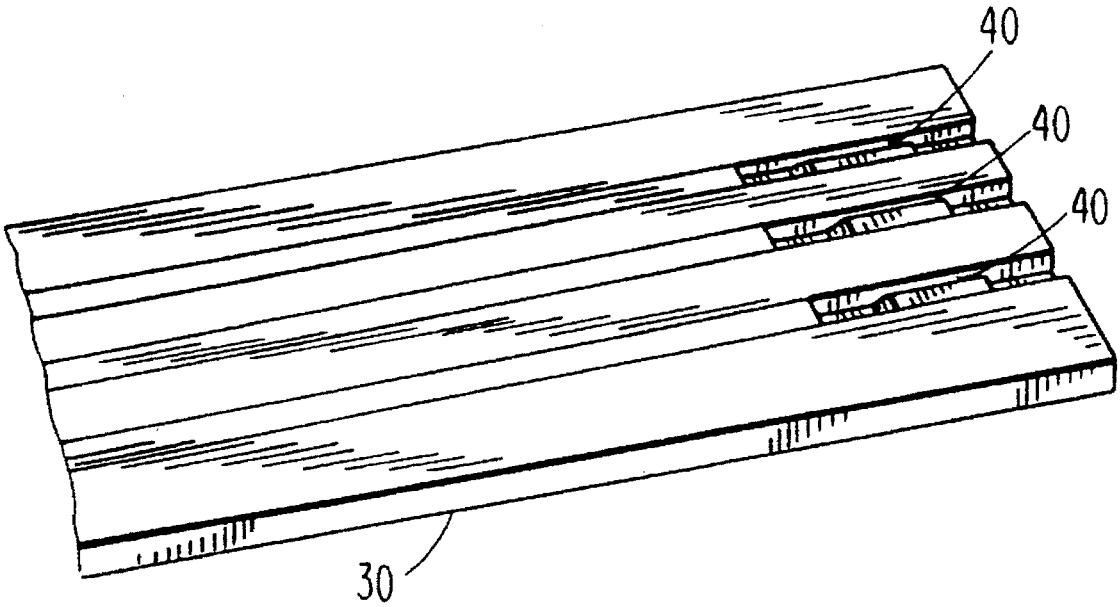
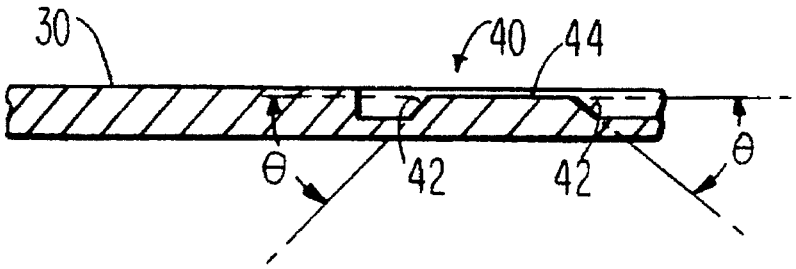
FIG. 6

APPARATUS FOR FORMING CURVED RECTANGULAR BODIED NEEDLES

CROSS REFERENCE TO RELATED APPLICATION

This is a divisional of U.S. application Ser. No. 08/135,602 filed Oct. 8, 1993, now U.S. Pat. No. 5,526,666, which is a continuation-in-part of prior application Ser. No. 07/958,926 filed Oct. 9, 1992, now abandoned, entitled NEEDLE CURVING APPARATUS, the disclosure of which is incorporated by reference herein.

BACKGROUND OF THE INVENTION

1. Field of the Invention

The present invention relates to needle forming devices. More particularly, the invention relates to a multistation needle forming device for flat pressing, curving and side pressing one needle blank, or a multiplicity of needle blanks, to form curved rectangular bodied needles. The device is capable of transferring the blanks from one die station directly to the next die station.

2. Description of the Related Art

The production of needles involves many processes and different types of machinery in order to prepare quality needles from raw stock. These varying processes and machinery become more critical in the preparation of surgical needles where the environment of intended use is in humans or animals. Some of the processes involved in the production of surgical grade needles include: straightening spooled wire stock, cutting needle blanks from raw stock, tapering or grinding points on one end of the blank, providing a bore for receiving suture thread at the other end of the blank, imparting flat surfaces on opposite sides of the blank by flat pressing a portion of the needle blank to facilitate grasping by surgical instrumentation and curving the needle where curved needles are desired. Additional processing may be done to impart flat surfaces substantially perpendicular to the flat pressed portions of the needle blank by side pressing a portion of the needle blank to further facilitate grasping by surgical instrumentation and insertion into humans or animals.

Conventional needle processing is, in large part, a labor intensive operation requiring highly skilled workmen. Generally, extreme care must be taken to ensure that only the intended working of the needle is performed and the other parts of the needle remain undisturbed.

Curved rectangular bodied needles have advantages over other needle configurations in many surgical procedures for a variety of reasons including, uniformity of entry depth for multiple sutures and proper "bite" of tissue surrounding the incision or wound. When providing curved rectangular bodied needles for surgical procedures it is desirable for the needles to have a specified rectangular cross-section and a specified curvature, i.e., a predetermined radius of curvature. The desired cross-section and radius of curvature for the finished needle varies with specific applications.

Known methods of forming curved rectangular bodied needles require several separate and distinct operations on various machinery. The needle blank must first be flat pressed to impart initial flat surfaces along barrel portions of the needle blanks located between a tapered point end of the blank and a drilled end. After flat pressing, the needle blank can then be taken from the flat press dies to a curving machine to impart the proper curvature to the needle blank. Care must be taken when removing the blanks from the flat press dies and positioning the needle blank in the curving machinery to avoid disturbing the flat surfaces imparted by the flat pressing operation.

After curving, the flat pressed and curved needle blanks can then be taken from the curving anvil to a side press station to impart flat surfaces substantially perpendicular to the flat pressed sides to give the final rectangular cross sectional profile to the needle barrel. Again care must be taken during removal of the needle blanks from the curving anvil and during side pressing so as to avoid disturbing the previously imparted flat pressed and curved portions of the needle blank.

Known flat pressing techniques create the flat edges on the needle barrel by pressing the barrel portion of the needle blank between a pair of opposing needle dies having the desired length and width characteristics. Typically, the needle blanks are inserted into a lower die and compressed between the dies to impart the flat surfaces on opposed sides of the needle barrels The flat pressed blanks can then be removed from the dies and taken to the curving machinery. After removal of the needle blanks, the dies can also be inspected to ensure no needle blanks remain stuck to one of the dies.

Known needle curving techniques create the curve by bending the needle blank around an anvil structure having a desired curvature. To attain the desired needle configuration, the anvil structure provides a shaping surface for deforming the needle. Typically, the needle is positioned for curving by manually placing the needle for engagement with the anvil structure and holding it in place by a holding device. The needle is subsequently bent by manipulating the holding device so the needle curvature is formed about the shaping surface of the anvil structure. Needles improperly positioned on the anvil may result in a deformation of the previously imparted flat press sides and may have to be reprocessed or discarded.

When needles are made of steel or similar resilient materials, the anvil or mandrel used should have a smaller radius than the radius desired in the final needle. This configuration allows for some springback after the bending operation and ensures that the desired radius of curvature is attained. A disclosure of such features may be found in, for example, U.S. Pat. No. 4,534,771 to McGregor et al.

After flat pressing and curving the needle blank it may be desirable to side press the barrel portion of the needle blank to obtain a rectangular cross-section in the needle barrel. As with the above flat press process, known side pressing techniques require inserting the blank between a pair of dies to compress and impart flat sides to the needle blank. Needles improperly positioned within the dies may become deformed and also have to be discarded or reprocessed.

One disadvantage to conventional needle forming techniques is that typically only one needle processing operation at a time, such as, for example, flat pressing between a pair of dies, curving around an anvil structure or side pressing between another set of dies, can be performed on a single piece of machinery. A further disadvantage is the long processing time and high costs required in forming and transporting the needles between the various machinery. Lastly, a still further disadvantage is the need to readjust several pieces of machinery to process needles of varying lengths and diameters thereby further increasing production time and costs.

Therefore, a need exists for a single needle forming apparatus that is capable of flat pressing, curving, and side pressing a multiplicity of needle blanks or a single needle blank by transporting the needle blanks directly between the various die sets of the same apparatus. It is also desirable to provide a needle forming device which cooperates with a needle feeding fixture for sequentially loading and positioning one or more needles at a first processing station so as to increase the production rate of the needle manufacturing process by maintaining a continuous flow of needle blanks through the device.

SUMMARY OF THE INVENTION

An apparatus is disclosed for forming at least one curved, flat sided surgical needle which comprises frame means, flat press means associated with the frame means for imparting first flat surfaces to opposite sides of at least portion of at least one needle blank and curving means associated with the frame means for imparting an arcuate profile to at least a portion of the at least one needle blank. The apparatus for forming at least one curved, flat sided surgical needle preferably comprises a frame portion, flat press means mounted on the frame portion for imparting first flat surfaces to opposite sides of at least a portion of at least one needle blank and curving means mounted on the frame portion for imparting an arcuate profile to at least a portion of the at least one needle blank.

The flat press means comprises upper die means and lower die means, the lower die means being adapted to support at least one surgical needle blank and the upper die means being engagable against the lower die means to impart first flat surfaces to opposite sides of the at least one needle blank positioned therebetween. The lower die means is in the form of a plate member reciprocally movable between a first position remote from the upper die means to a second position adjacent the upper die means.

The upper die means and the lower die means include needle die portions having lead in tapers dimensioned and configured for flat pressing only a center portion of the needle blank, the lead in tapers providing a clearance to prevent flat pressing of a tapered end and a drilled end portion of the needle blank. The lead in tapers in the upper and lower die means are approximately 3° to 15° and more approximately 5°. The lower die means includes at least one longitudinal die channel or groove to support the at least one needle blank. The plate member is reciprocally movable between the second position adjacent the upper die means to a third position adjacent the curving means to directly transfer the at least one needle blank between the plate member and the curving means.

The curving means preferably comprises mandrel means for imparting an arcuate profile to at least a portion of the at least one needle blank and reciprocating means for biasing and reciprocally moving the at least one needle blank against the mandrel means. The mandrel means comprises a rotatable shaft having at least a portion configured to impart the arcuate profile to the at least one needle blank. The apparatus, wherein the portion of the shaft comprises a curvature having a predetermined radius in the range of between about 0.05 inches and about 3.00 inches.

The reciprocating means cooperates with the mandrel means to accept a needle blank therebetween from the flat press means and preferably comprises at least one pair of rotatable members positioned in adjacency and belt means positioned about the at least one pair of rotatable members for biasing and reciprocally moving the at least one needle blank against the mandrel means. The reciprocating means further comprises belt drive means for selectively moving the belt means and tensioning means for applying tension to the belt means.

The tensioning means preferably comprises at least one tensioning roller biased toward the belt means. The belt means comprises an elastic belt and is fabricated from a material selected from the group of materials consisting of Neoprene, Nylon, Polyurethane or Kevlar. Biasing means is provided for applying a continuous force to at least one of the pair of rotatable members such that a friction fit is maintained between the curving means, the at least one pair of rotatable members and the at least one needle blank when the curving means is engaged with the reciprocating means.

According to the invention, side press means is mounted on the frame portion for imparting second flat surfaces to opposite sides of the needle blank, wherein the second flat surfaces are imparted substantially perpendicular to the first flat surfaces. The side press means includes side die means for supporting the needle blank and clamp means for pressing the side die means about the needle blank. The side die means has a plurality of adjacent plate members, each the adjacent plate member having at least one die slot or groove coacting with a corresponding die slot in said next adjacent plate member to support a needle blank therebetween. The corresponding die slots cooperate to form side press dies, the dies having lead in tapers of approximately 3° to approximately 15° and preferably about 5°.

The side die means is rotatable from a first position adjacent the curving means for direct receipt of the needle blanks therefrom to a second position adjacent the clamp means for side pressing the needle blank therebetween. The side die means is also rotatable from the second position adjacent the clamp means to a third position removed from the clamp means. Means in the form of air jet means is provided to urge the needle blanks free from the side die means to remove the needle blanks from the side die means when the side die means is in the third position. The removal means comprises Detection means is provided for sensing the presence of the at least one needle blank in the lower die means. Detachable feed means for supplying a plurality of needle blanks to the lower die means is also provided. The feed means includes a feed block having a plurality of V-shaped hoppers. Each hopper has cascade means at a base thereof for supplying the needle blanks one at a time into each of a plurality of lower die slots in the lower die means.

Also, the preferred apparatus for forming at least one curved, rectangular sided surgical needle comprises a frame assembly. A flat press means is affixed to the frame assembly for imparting first flat surfaces to first opposing sides of at least a portion of at least one needle blank. A curving means is affixed to the frame assembly for imparting an arcuate profile to at least a portion of the needle blank. A side press means is affixed to the frame assembly for imparting second flat surfaces to second opposing sides of the needle blank. The second flat surfaces are imparted substantially perpendicular to the first flat surfaces.

There is also disclosed a method of forming a curved rectangular bodied needle from a substantially round-elongated needle blank. The method comprises the steps of flat pressing opposite sides of the needle blanks between a pair of flat press dies. The needle blanks are drawn from at least one of the flat press dies onto a rotatable mandrel curving the needle blanks between the rotatable mandrel and a reciprocable belt. The needle blanks are rotated adjacent side press dies and the needle blanks are deposited therebetween. Opposite sides of the needle blanks are side pressed between the side press dies. The side pressing acts on sides of the needle blanks substantially perpendicular to the flat pressed sides.

The flat pressing steps comprise positioning the needle blanks on a lower flat press die member. Then the lower die member is advanced adjacent an upper flat press die member. The needle blanks are compressed between the upper flat press die member and the lower flat press die member. The lower flat press die member is advanced adjacent the reciprocable belt.

The curving steps comprise drawing the needle blanks off at least one of the flat press dies between said mandrel and the belt by advancement of the belt and pressing the belt against the needle blanks and reciprocating the belt to form the needle blanks about the rotatable mandrel.

The side pressing steps comprise capturing the needle blanks between a plurality of adjacent die plates rotating said die plates between a pair of clamp members and clamping the die plates about the needle blanks by squeezing the clamp members against the die plates.

Also there is disclosed a needle having a tapered distal portion, a rectangular central portion and a bored proximal portion formed on to the apparatus. The tapered distal portion has a generally circular cross-section, the rectangular central portion is generally square and the bored proximal portion has a generally circular cross-section.

Finally, there is disclosed a needle having a tapered distal portion, a rectangular central portion and a bored proximal portion formed according to the method. The tapered distal portion has a generally circular cross-section, the rectangular central portion is generally square and the bored proximal portion has a generally circular cross-section.

BRIEF DESCRIPTION OF THE DRAWINGS

Preferred embodiments of the invention are described hereinbelow with reference to the drawings wherein;

FIG. 5 is a perspective view of the lower die plate of the apparatus of FIG. 1;

FIG. 6 is a cross-sectional view of the lower die plate of FIG. 5;

DETAILED DESCRIPTION OF THE PREFERRED EMBODIMENTS

Generally, the needle forming apparatus of the present invention is utilized to flat press, curve or bend and side press a multiplicity of needle blanks to produce curved, rectangular bodied needles. However, pressing and curving of a single needle blank is also contemplated. As used herein, the term needle blank refers to a surgical needle in various stages of fabrication.

Figure 1:
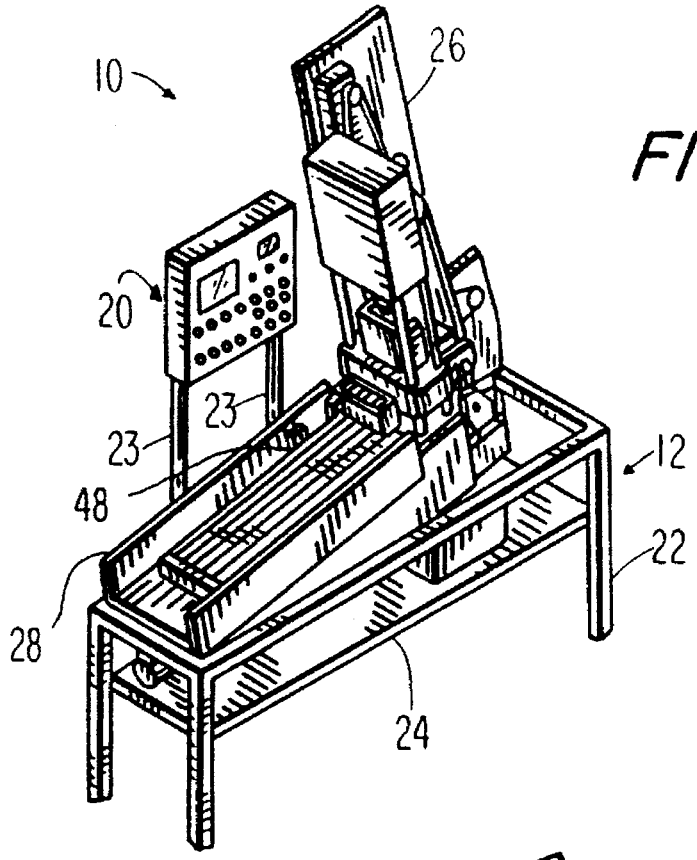
FIG. 1 is a perspective view of the needle forming apparatus of the present invention.
Figure 2:
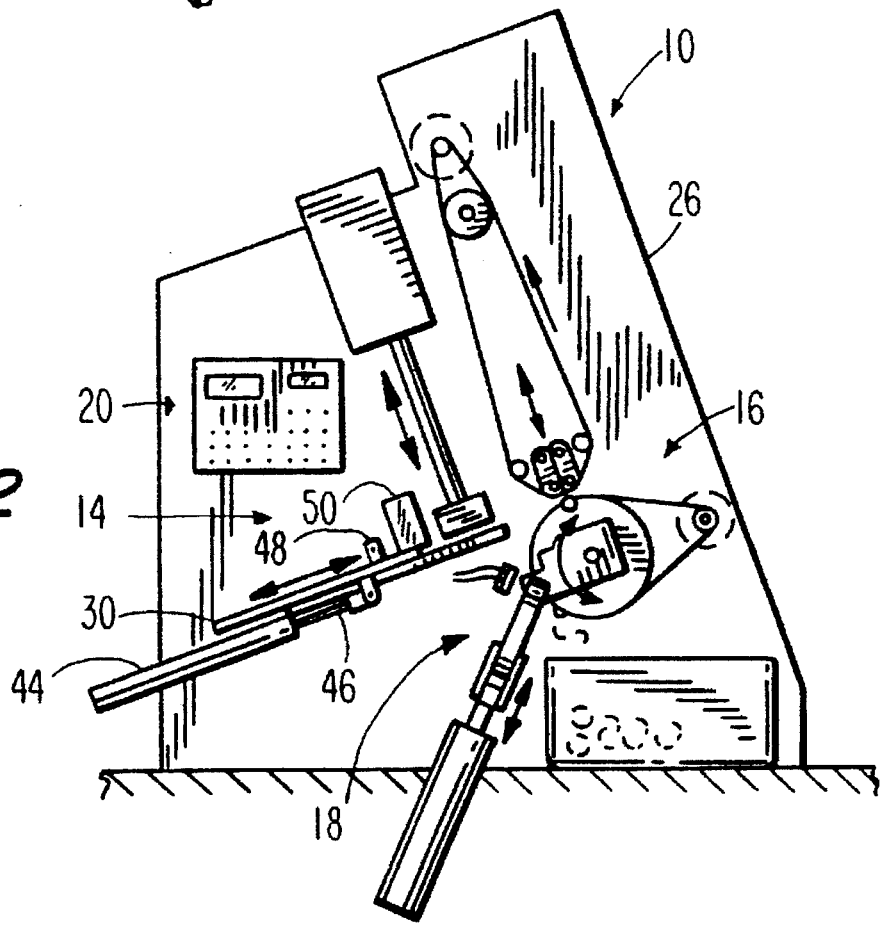
FIG. 2 is a side elevation view of the apparatus of FIG. 1.

Needle forming apparatus 10 is illustrated in FIGS. 1 and 2 and generally includes a support stand 12, a flat press station 14, a curving station 16, a side press station 18, and a computer controller 20, all of which are, preferably, connected to support stand 12. Referring to FIGS. 1 and 2, support stand 12 generally includes a base frame 22 having a shelf 24 and a back plate 26. Preferably, curving station 16 and side press station 18 are mounted with respect to back plate 26. Support stand 12 further includes an inclined shelf 28 extending between one end of support stand 12 and flat press station 14. As shown in FIGS. 1 and 2, a computer control station 20 may be mounted on back plate 26 or supported separately by legs 23.

Figure 3:
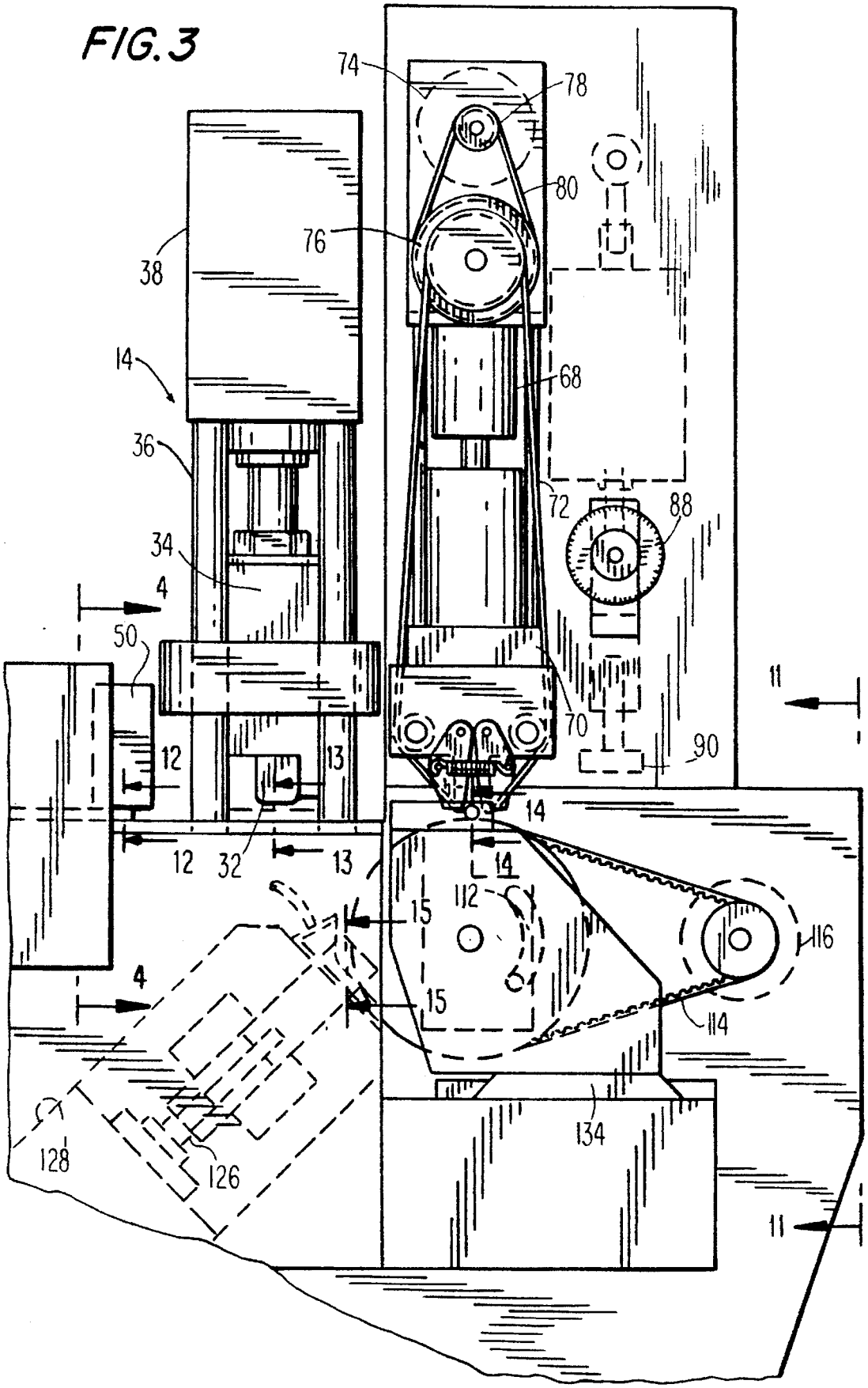
FIG. 3 is an enlarged elevation view of the three needle forming stations of the apparatus of FIG. 1.
Figure 4:
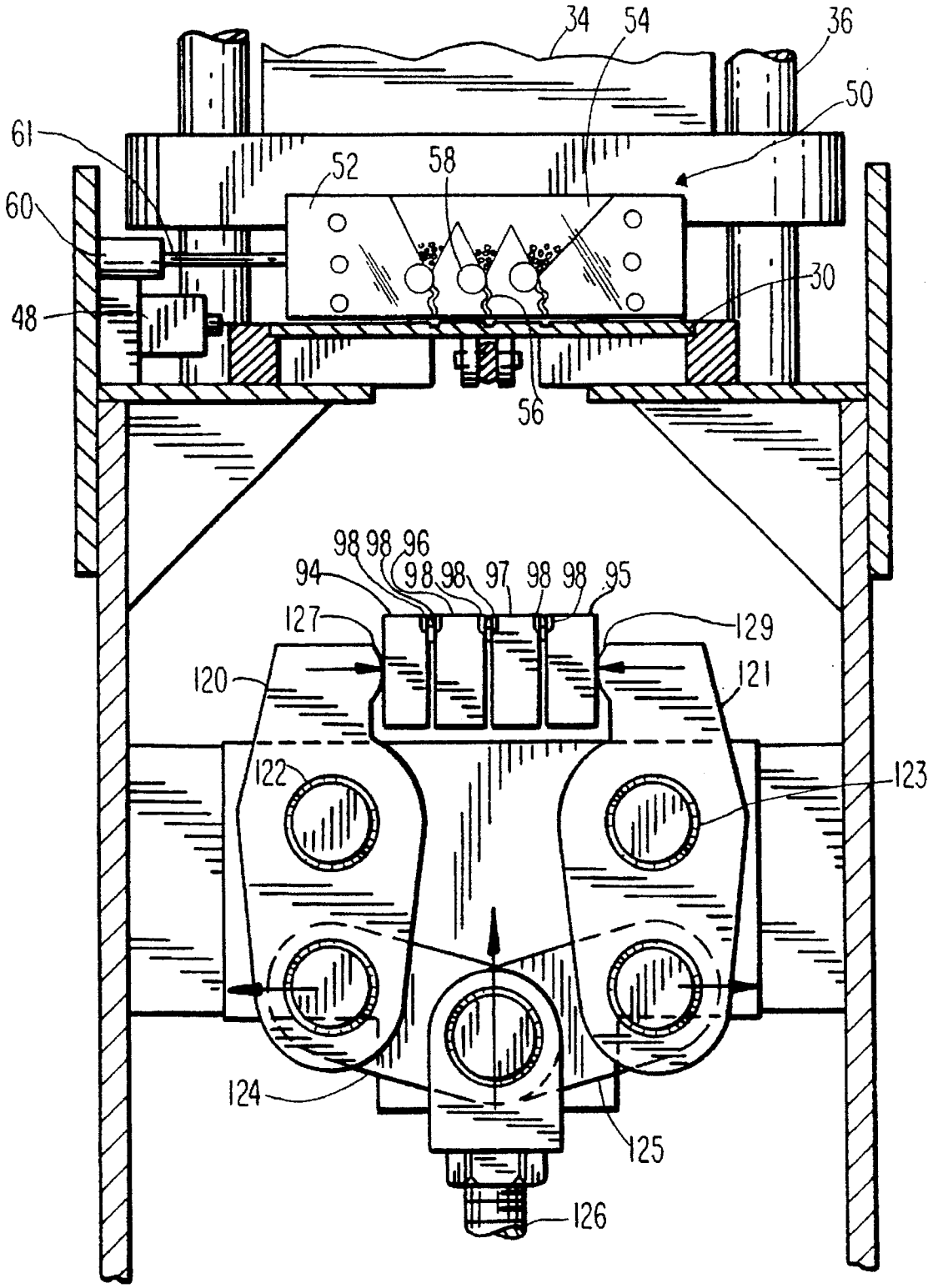
FIG. 4 is a partial cross-sectional view taken along the lines 4—4 of FIG. 3.

Referring now to FIGS. 2–4, flat press station 14 includes an upper die plate 32 which is affixed to and suspended beneath a flat press ram 34. Flat press ram 34 is slidably mounted on support members 36 and is movable in a vertical direction by means of a hydraulic cylinder 38. The direction of movement of flat press ram 34 and the force applied thereto by hydraulic cylinder 38 are controlled and can be adjusted by computer control station 20. Preferably, flat press ram 34, and thus upper die plate 32 which is affixed thereto, has a vertical range of travel of approximately 2.0 inches. Additionally, hydraulic cylinder 38 can supply a pressure of approximately 10,000 psi to upper die plate 32.

Flat press station 14 further includes a movable lower die plate 30. Lower die plate 30 is slidably supported and reciprocal along inclined shelf 28. A worm screw motor 44 connected to lower die plate 30 by worm screw shaft 46 is provided to reciprocate lower die plate 32 between a first position remote from upper die plate 32 to a second position adjacent to and beneath upper die plate 32. Additionally, lower die plate 30 is reciprocally movable between the first and second positions and a third position adjacent to curving station 16. The direction and speed of motor 44 and thus lower die plate 30 are controlled by computer control station 20.

Referring now to FIGS. 5 and 6, lower die plate 30 further includes a plurality of needle die slots or grooves 40 which are configured, dimensioned and adapted to retain and position a single or several needle blanks on lower die plate 30 for flat pressing between lower die plate 30 and upper die plate 32. As shown in FIG. 6, lower die plate 30 and specifically needle grooves 40 are formed with lead in tapers 0 formed between surfaces 42 and 48 on lower die plate 30. Taper 0 provide clearance for a drilled or bored end portion of the needle and a tapered or pointed end portion of the needle blank to prevent damage to the end portions of the needle blank during pressing between upper die plate 32 and lower die plate 30. Preferably, lead in tapers 0 are on the order of 3° to 15° or more preferably on the order of approximately 5°. Grooves 40 are preferably 0.5 inches long to accommodate needle blanks ranging in length from 0.300 to 1.5 inches and are further dimensional to hold needle blanks ranging from 0.008 to 0.032 inches in diameter. Upper die plate 32 may also include similar die slots or grooves and lead in tapers to help protect the tapered end and drilled end portions of the needle blanks.

Referring again to FIG. 1, flat press station 14 may further include a camera or other sensing eye 48 positioned adjacent lower die plate 30 and remote from upper die plate 32. Eye 48 is provided to count the number of needle blanks in grooves 40 before and after flat pressing to assure that no needle blanks remain lodged against upper die plate 32 after flat pressing has been completed. Upper die plate 32 and lower die plate 30 may be coated with various materials to help prevent needle blanks from adhering thereto. Upper die plate 32 and lower die plate 30 are preferably fabricated from a material having a hardness which is at least substantially equal to the hardness of the needle blank material. Typically die plates 30 and 32 have a Rockwell hardness value of between 40C to about 70C. Die plates 30 and 32 are preferably adapted to press three needle blanks at a time although other amounts of needle blanks may be pressed by changing the number of grooves 40 in the die members.

Figure 12:
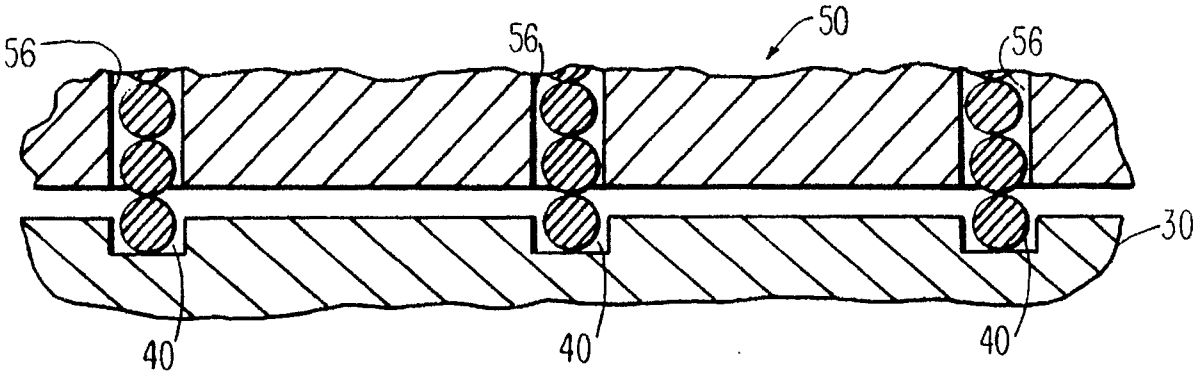
FIG. 12 is an enlarged partial cross-sectional view taken along the lines 12—12 of FIG. 3 and illustrating needle blanks being fed from the feed hopper to the lower die plate.

While it is possible to feed needle blanks into needle grooves 40 by hand, needle forming apparatus 10 preferably includes a needle hopper 50 which can retain a supply of needle blanks and feed them one at a time into each needle groove 40. Referring now to FIGS. 4 and 12, needle hopper 50 generally includes a face plate 52, preferably formed of a clear plastic, affixed to a front section of needle hopper 50. Needle hopper 50 is further provided with 3 V-shaped hopper sections 54 which funnel down to three curved or cascade style feed grooves 56. Hopper sections 54 function to supply feed grooves 56 with a continuous supply of needle blanks. As seen in FIGS. 4 and 12, feed grooves 56 are oriented and positioned to deposit one needle at a time into lower die plate needle grooves 40 when lower die plate 30 is slid beneath needle hopper 50. As shown in FIG. 4, flow control knobs 58 are provided at the base of each hopper section 54 to prevent or allow needle blanks to flow from hopper sections 54 to curved feed grooves 56. It has been found that by using V-shaped hopper sections 54 and curved or cascade path feed grooves 56 reliable and consistent feeding of needle blanks to lower die plate grooves 40 can be maintained. Occasionally, needle blanks may become wedged against one another or hopper 50 as they flow down V-shaped hopper sections 54 and through feed grooves 56. To help prevent wedging of any needle blanks in hopper 50, needle forming apparatus 10 may further be provided with a vibrator 60 which gently vibrates needle hopper 50 by means of bar 61 to ensure that needles to not become stuck or wedged together and to ensure that the needle blanks will flow freely into and through curved feed grooves 56.

Figure 7:
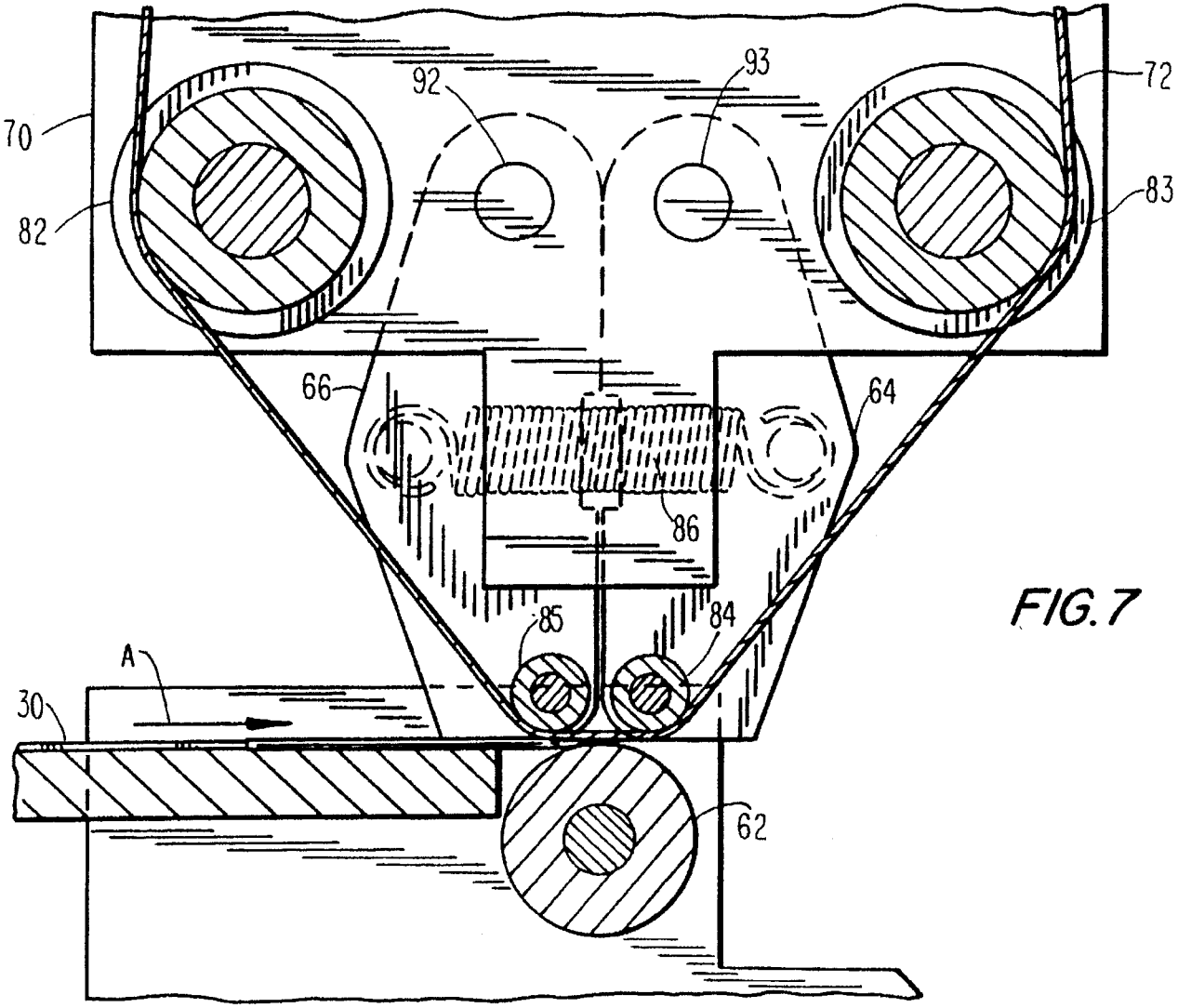
FIG. 7 is an enlarged partial side elevational view of the needle curving station shown in FIG. 2.

As noted above, lower die plate 30 is reciprocal between a position adjacent flat press station 14 and a position adjacent curving station 16 to transfer needle blanks therebetween. Referring now to FIG. 7, needle curving station 16 of the present invention preferably includes a rotatable curving mandrel 62 and right and left needle curving jaws, 64 and 66, respectively. Jaws 64 and 66 are preferably pivotally mounted to a curving ram 70 by means of pivot pins 92 and 93. As shown in FIG. 3, curving ram 70 is reciprocally movable in a vertical direction by means of a hydraulic curving cylinder 68. A curving belt 72 is provided to draw needle blanks out of needle die grooves 40 when lower die plate 30 is positioned adjacent curving mandrel 62. Belt 72 surrounds jaws 64 and 66 at one end and a pulley 76 at the other end as shown in FIG. 3. A motor 74 is provided to turn pulley 76 by means of a motor belt 80 and a motor belt pulley 78. Motor 74 may be actuable in clockwise and counterclockwise directions to reciprocate belt 72 about the ends of jaws 66 and 64.

Figure 9:
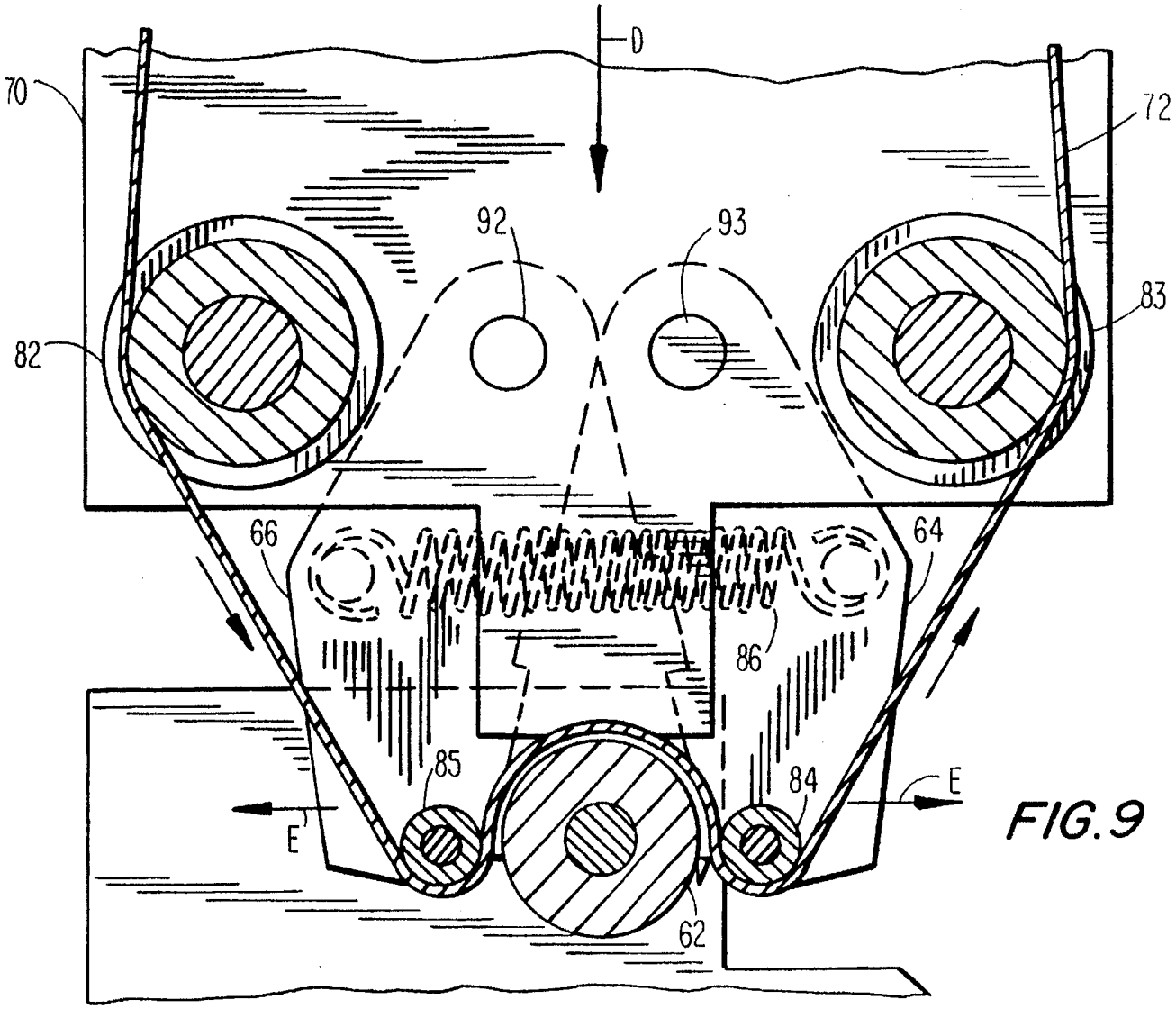
FIG. 9 is an enlarged partial side elevational view illustrating the needle being curved about the mandrel.

A pair of ram rollers 82 and 83 of FIG. 7 are rotatably affixed to curving ram 70 to guide and tension belt 72. A pair of jaw rollers 84 and 85 are affixed to jaws 64 and 66, respectively to guide belt 72 around jaws 64 and 66 and to aid in reciprocating and biasing belt 72 against the needle blanks. Belt 72 is positioned around jaw rollers 84 and 85 on jaw 64 and ram rollers 82 and 83 on ram 70. As shown in FIG. 7, jaws 64 and 66 are biased together by a spring 86. As shown in FIGS. 7 and 9, jaws 64 and 66 are movable between an initial position where rollers 84 and 85 are adjacent each other and above mandrel 62 to a curving position. In the curving position, ram 70 is biased downward by hydraulic cylinder 68 of FIG. 3. This forces jaws 64 and 66 open and apart from each other causing jaws 64 and 66 and belt 72 to surround mandrel 62 thereby holding a needle blank therebetween.

Mandrel 62 is preferably an elongated shaft or rod positioned transversely with respect to lower die plate 30. Mandrel 62 has a solid cross-section and is fabricated from a material having a hardness which is at least substantially equal to the hardness of the needle blank material. Typically, mandrel 62 has a rockwell hardness value of between about (55C) and about (57C). This hardness discourages unwanted shaping or marring of the needle blank and/or mandrel 62. In addition, mandrel 62 may be coated with an elastomer material to help prevent unwanted marring of the needle blank and/or mandrel 62 during the current process.

Preferably, mandrel has a circular cross-section to impart an arcuate profile to the needle blank resulting in a curved surgical needle having a predetermined radius of curvature of between about (0.5") and about (3.0"). However, surgical needles requiring different arcuate profiles require various shaped mandrels, such as elliptical, triangular, rectangular, or pear-shaped mandrels which impart a predetermined curvature to the needle blanks. The diameter of the preferred circular mandrel is dependent on numerous factors including the length of the needle blank desired radius of curvature, and the spring back characteristics of the needle material, i.e., the tendency of the needle material to return to its original shape after being deformed. To illustrate, larger diameter mandrels produce a larger radius of curvature and smaller diameter mandrels produce a smaller radius of curvature. Further, in instances where the needle blank is fabricated from a material having spring back tendencies, the mandrel diameter should be smaller than the desired radius of curvature. Thus, the needle will spring back to the desired radius of curved after bending. The apparatus of the present invention is configured to accommodate mandrels with various diameters necessary for curving surgical needles of various sizes.

As shown in FIG. 3, an adjustment knob 88 is provided to adjust the tension of belt 72 around jaws 64 and 66. Specifically as jaws 64 and 66 are moved up and down by ram 70, belt 72 may stretch or otherwise become elongated. Belt tension adjustment knob 88 allows for vertical adjustment of pulley 76 to compensate for elongation of belt 72. Further, a jaw stop adjustment knob 90 is also provided to limit the vertical downward movement of ram 70 and thus of jaws 64 and 66 about curving mandrel 62. The motions of the belts, jaws and hydraulic cylinders are controlled by computer station 20.

As can be seen in FIGS. 7–10, needle curving station 16 is adapted to receive needle blanks directly from lower die plate 30. This is done by reciprocating lower die plate 30 to a position adjacent mandrel 62 and belt 72 and rotating belt 72 to draw the needle blanks between mandrel 62 and the belt 72. In this manner a needle blank is transported from lower die plate 30 of flat press station 14 directly to curving mandrel 62 of curving station 16 without ever having to remove the needle blanks from the needle forming apparatus 10 or subject the needle blanks to transportation mechanisms other than the die plates.

Figure 11:
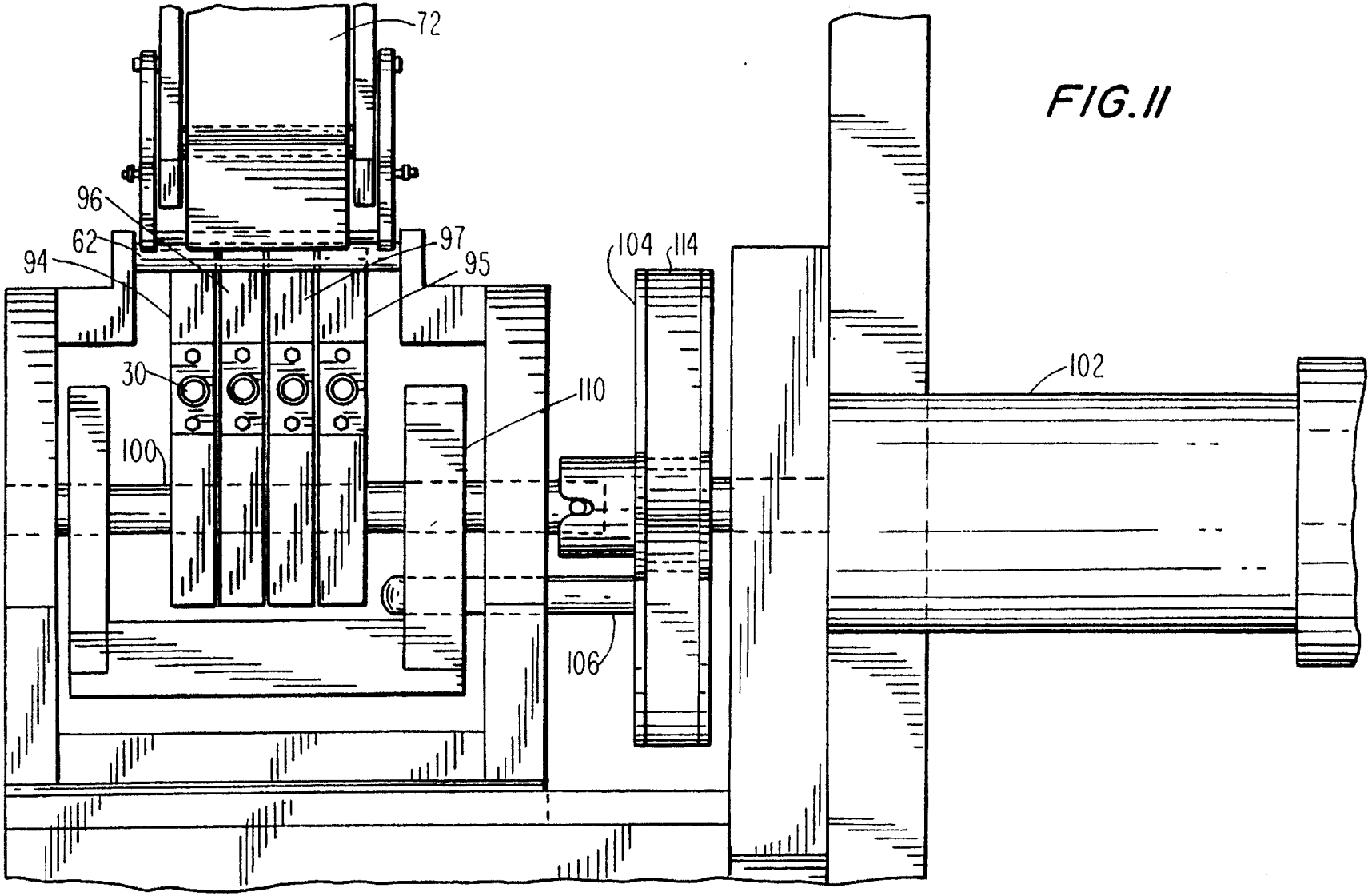

Referring now to FIGS. 3 and 11, needle side press station 18 includes a plurality of side press die plates adapted to receive needle blanks from curving station 16 and hold them for side pressing within side press station 18. As shown in FIGS. 4 and 11, side press station 18 is provided with a pair of end side press die plates 94 and 95 having die grooves 98 on an inner surface only thereof and two center side press die plates 96 and 97, each having die grooves 98 on both exterior faces. Side press die plates 94, 95, 96 and 97 are mounted with respect to an indexing shaft 100 which is adapted to rotate die plates 94, 95, 96 and 97 between a first position adjacent curving station 16 to a second position for side pressing. Indexing shaft 100 is rotated by a stepper type motor 102 via a drive wheel 104 and a drive belt 114. Drive belt 114 surrounds drive wheel 104 at one end and a drive pulley 116 at another end. Pulley 116 is connected to stepper motor 102 for rotation therewith. A cam rod 106 extends outward from drive wheel 104 and engages a groove 112 in a side press die carriage 110. Indexing shaft 100 may also include means to bring die plates 94, 95, 96 and 97 together to hold needle blanks therebetween and to separate the die plates to accept and release needle blanks.

Referring now to FIGS. 3, 4, 15 and 16, it can be seen that side press station 18 further includes a pair of side die rams 120 and 121 which are pivotally supported by pivot pins 122 and 123. A pair of toggle links 124 and 125 are pivotally affixed at one end of side die rams 120 and 121. Toggle links 124 and 125 overlap at one end thereof and are connected to a drive shaft 126. Drive shaft 126 is reciprocally movable by means of a hydraulic cylinder 128 (FIG. 3). By advancing drive shaft 126 toggle links 124 and 125 force side die rams 120 and 121 outward to pivot die rams 120 and 121 around pivot pins 122 and 123. This forces the opposite ends of the die rams to compress inwardly. The ends of side die rams 120 and 121 opposite toggle links 124 and 125 are provided with inwardly directed ends 127 and 129. As shown specifically in FIG. 4, inward movement of inwardly directed ends 127 and 129 of side die rams 120 and 121 compresses side die plates 94, 95, 96 and 97 about needle blanks positioned within needle die grooves 98.

Die plates 94, 95, 96 and 97 are rotatable with respect to side press die carriage 110 to rotate from a first position (where die grooves 98 are adjacent needle curving station 16) to a second position (where die plates 94 and 95 are positioned between side die rams 120 and 121 for side pressing therebetween). After side pressing, side press die plates 94, 95, 96 and 97 are movable between the second position and a third position adjacent a needle receptacle 134 (FIG. 3). Side press die plates 94, 95, 96 and 97 may each be provided with blow holes 130 which are communicable between an outside surface of the die plates and needle die grooves 98. When carriage 110 is rotated to position the die plates in the third position, blow holes 130 align with an air manifold 132. Means are provided for forcing a flow of air through manifold 132 and thus through blow holes 130 to eject needle blanks from die grooves 98 after die plates 96, 97 and 98 separate. Preferably side press station 18 simultaneously presses three needle blanks. However, other amounts of needle blanks may be pressed by increasing or decreasing the number of side plates and thus the number of needle die grooves 98.

Figure 10:
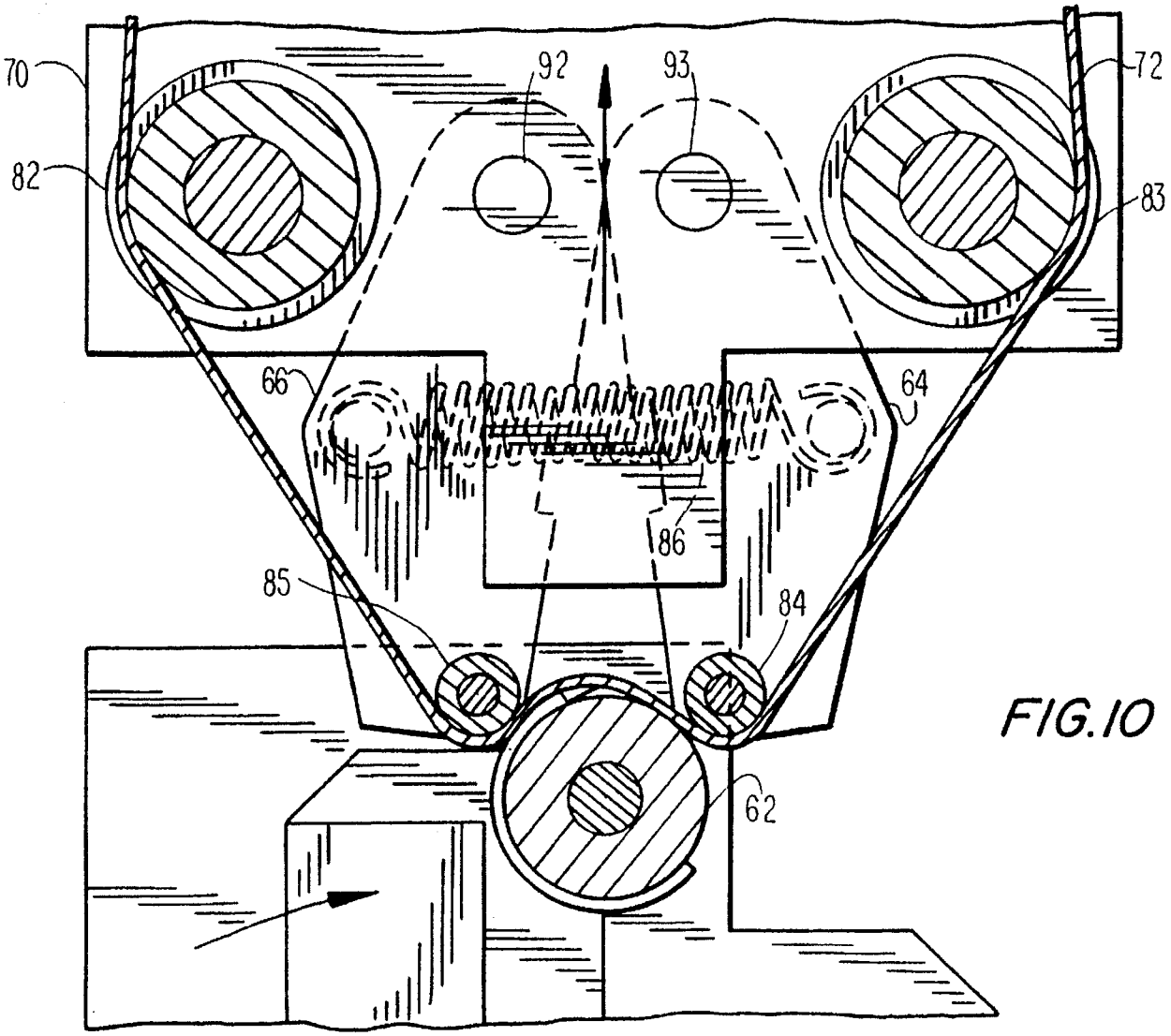
FIG. 10 is an enlarged partial side elevational view showing the needle being rotated for acceptance by the FIG. 11 is an enlarged partial end elevational view taken along the lines 11—11 of FIG. 3.

Turning now to the operation of needle forming apparatus 10, a plurality of needle blanks are initially placed within hopper sections 54. As shown in FIGS. 1, 4 and 10, upon opening flow knobs 58, needle blanks flow from the hopper sections 54 through needle grooves 56 which deposit a single needle blank in each of lower die plate needle grooves 40. At this stage lower die plate 30 retracts to a position adjacent the eye 48 which views the number of needle blanks positioned within the needle grooves. Computer 20 counts the number of needle blanks viewed and stores the number of in memory. After counting the number of needles blanks present in lower die plate 30, lower die plate 30 is advanced to a position adjacent to and directly beneath upper die plate 32. Upper die plate 32 is then forced downward by means of flat press ram 34 and hydraulic cylinder 38 to compress the needle blanks between the upper and lower die plates 32 and 30, respectively.

As noted above, needle grooves 40 are provided with lead in tapers 42 which prevent drilled end portions and tapered end portions of the needle blanks from being flat pressed between upper die plate 32 and lower die plate 30. After the needle blanks are flat pressed between lower die plates 30 and upper die plate 32, lower die plate 30 is again retracted adjacent eye 48 which views the needle blanks. This allows the computer to recount the number of needle blanks present in lower die plate needle grooves 40 and compare the result to the number of needle blanks originally viewed to insure that no needle blanks remain lodged against upper die plate 32.

Figure 8:
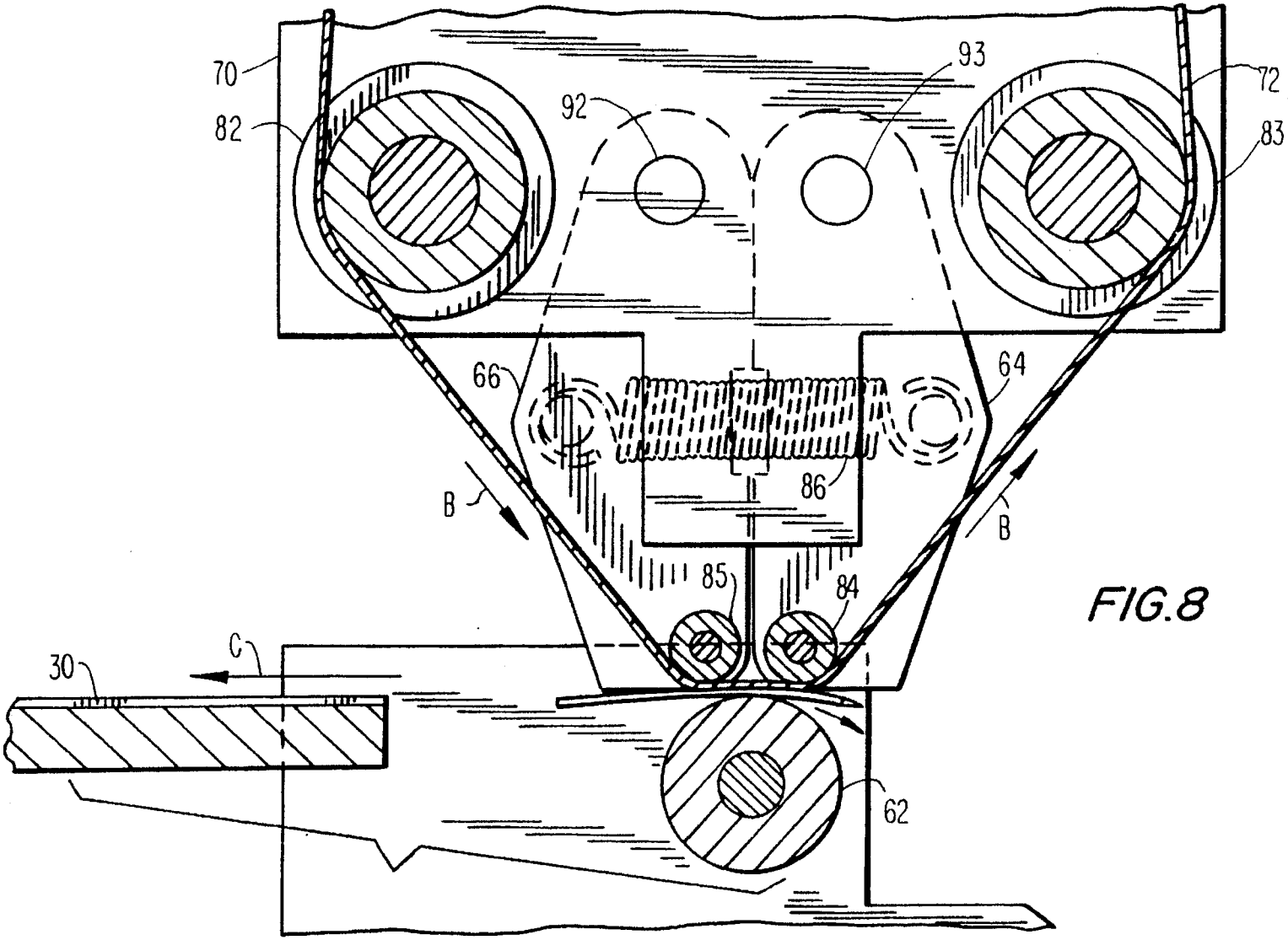
FIG. 8 is an enlarged partial side elevational view of the needle curving station illustrating a needle blank drawn between the curving belt and the curving mandrel.

Referring now specifically to FIGS. 2, 7 and 8, it can be seen that after flat pressing the needle blanks, lower die plate 30 advances beneath and past upper die plate 32 in the direction of arrow A to a position adjacent belt 72 and mandrel 62 as best shown in FIG. 7. At this point belt 72 is rotated slightly in the direction of arrows B (FIG. 8) to draw the needle blanks out of needle grooves 40 and to position the needle blanks between belt 72 and mandrel 62.

The curving sequence of curving station 16 will now be described specifically with reference to FIGS. 8 and 9. Once needle blanks have been drawn between mandrel 62 and belt 72, and lower die plate 30 has been retracted in the direction of arrow C, ram 70 is forced downward in the direction of arrow D by hydraulic cylinder 38 (FIG. 3) to force open jaws 64 and 66 (arrows E) against the tension of spring 86. The downward motion of ram 70 causes belt 72 to move down and around the needle blanks and mandrel 62 as shown in FIG. 9. At this point belt 72 is reciprocated back and forth through a slight motion by means of motor 74 to curve needle blank about mandrel 62. Rollers 82, 83, 84 and 85 insure belt 72 rotates needle blanks smoothly about curving mandrel 62. Belt 72 and jaws 64 and 66, as tensioned by spring 86, are sufficiently resilient to insure that the needle blanks are merely curved about mandrel 62 and not compressed or flat pressed to any significant extent. This insures that a drilled end portion and a tapered end portion of the needle blanks are not deformed during the curving process between belt 72 and mandrel 62.

Referring now to FIGS. 10 and 11 it can be seen that as belt 72 is further rotated, the needle blanks are rotated about mandrel 62. This positions the needle blanks for deposit in needle die grooves 98 of side press die plates 94, 95, 96 and 97. As noted above, side press die plates 94, 95, 96 and 97 are rotatable to a first position adjacent to curving station 16. At this point the plates are expanded slightly to make room for the needle blanks within needle grooves 98. Belt 72 rotates the needle blanks into die grooves 98. Die plates 94, 95, 96 and 97 are then compressed slightly to hold the needle blanks within die grooves 98. In this manner, needle blanks are transported from a needle hopper 50 through flat press and curving stations 14 and 16, respectively, to side press station 18. This occurs without having to remove the needle blanks from needle forming apparatus 10. As noted above, this direct handling of the needle blank between flat press station 14, curving station 16 and side press station 18 insures consistent and reliable forming of needle blanks.

Referring now to FIG. 4, side press die plates 94, 95, 96 and 97 are now pivoted to a position between side rams 120 and 121. Actuation of hydraulic cylinder 128 drives die shaft 126 upwardly forcing toggle links 124 and 125 to pivot side press die rams 120 and 121 about pivot pins 122 and 123 thereby forcing ends 127 and 129 of side press dies 120 and 121, respectively, against side press die plates 94 and 95 compressing plates 96 and 97 together to side press needles captured in needle die grooves 98. As noted above with respect to flat press die plate 30, side press die plates 94, 95, 96 and 97 may also be provided with lead in tapers similar to tapers 0 to insure that the drilled end portions and tapered end portions are not deformed during the side press operation. As also noted above, these lead in tapers 0 may be approximately on the order of between 3 and 15 degrees and preferably on the order of approximately 5 degrees. Hydraulic cylinder 38 can compress side press rams 120 and 121 with a force of approximately 10,000 to 15,000 psi and preferably approximately 12,500 psi. The motions of the side press operations are controlled by computer station 20 which also coordinates the motions of all three needle forming stations 14, 16 and 18.

After the needle blanks are side pressed between die plates 94, 95, 96 and 97 by side die rams 120 and 121, side press die carriage 110 can be rotated to the third position thereby positioning blow holes 130 on plates 94, 95, 96 and 97 adjacent air manifold 132. Die plates 94, 95, 96 and 97 are separated slightly and air is injected through manifold 132, and thus through blow holes 130, to force the needle blanks out of die grooves 98 into needle blank receptacle 134. Needle blank receptacle 134 is preferably formed of a foam, e.g., Neoprene material to insure that needle blanks deposited therein are not deformed during ejection of the needles from die grooves 98.

The needle forming apparatus 10 of the present invention is particularly adapted to transport a plurality of tapered and drilled needle blanks from an initial position within hoppers 54 through flat press station 14, curving station 16 and side press station 18 and into receptacle 134 without having to remove or touch the needle blanks. And more particularly, needle forming apparatus 10 moves the needle blanks directly from one die set to another without any intervening transport mechanisms.

Figure 13:
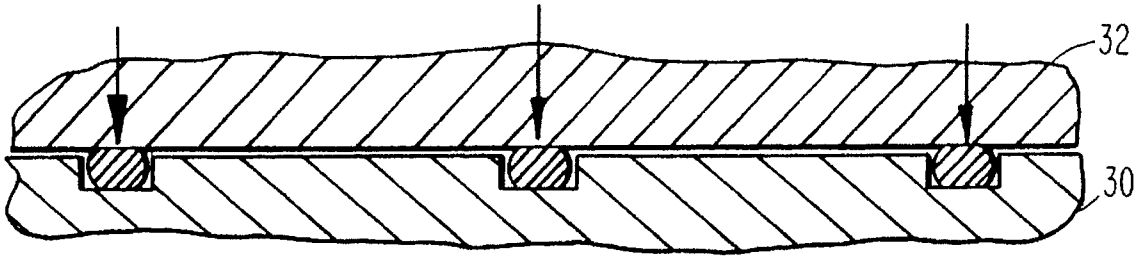
FIG. 13 is an enlarged partial cross-sectional view taken along the lines 13—13 of FIG. 3 illustrating the needle blanks being flat pressed between the upper die plate and the lower die plate.
Figure 14:
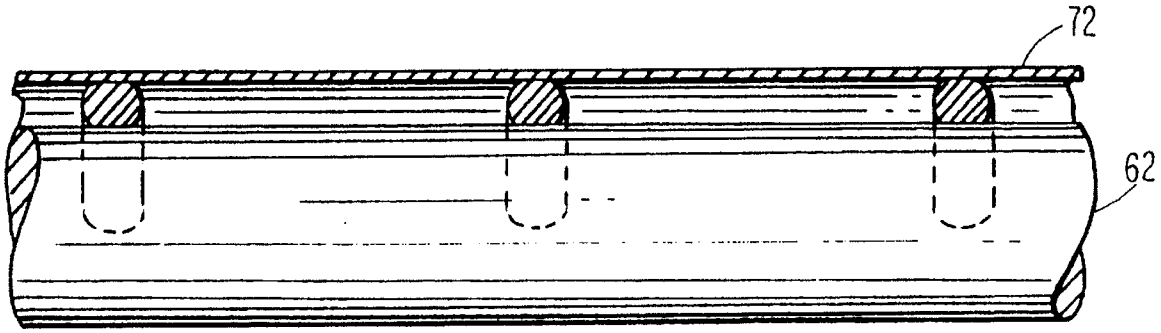
FIG. 14 is an enlarged partial cross-sectional view taken along the lines 14—14 of FIG. 3 illustrating the needle blanks being curved about the mandrel by the curving belt.
Figure 15:
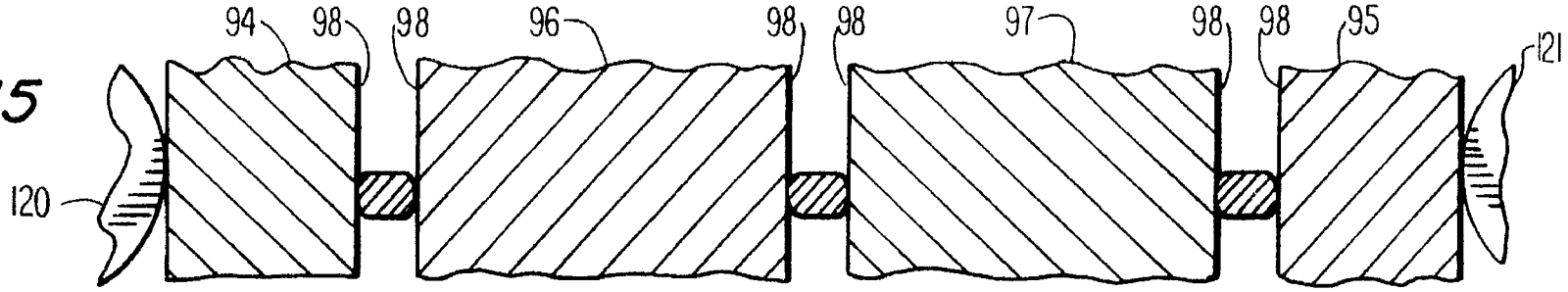
FIG. 15 is an enlarged partial cross-sectional view taken along the lines 15—15 in FIG. 3 illustrating the needle blanks positioned between the side press die plates.
Figure 16:
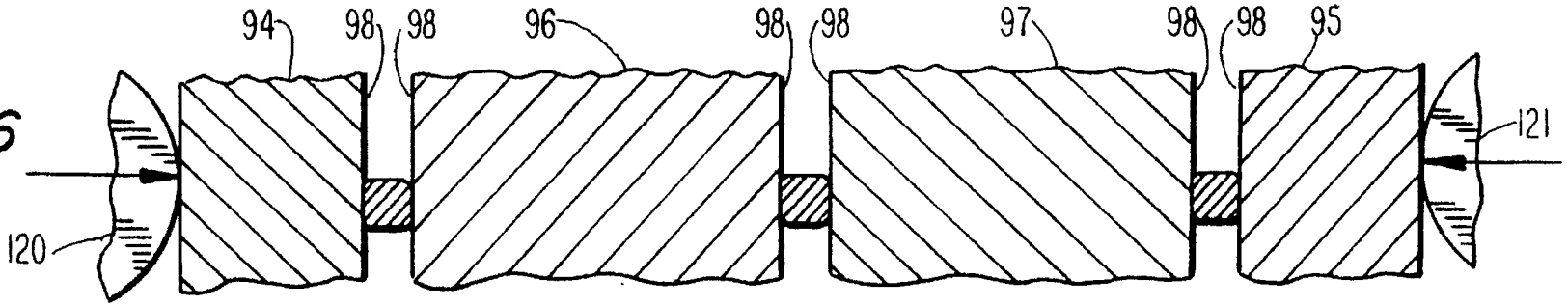
FIG. 16 is an enlarged partial cross-sectional view similar to FIG. 15, illustrating the needle blanks being side pressed between the side press dies.
Figure 17:
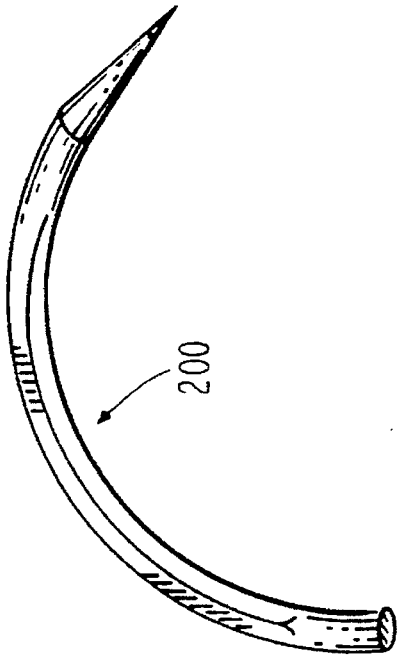
FIG. 17 is a perspective view of a needle formed by the needle forming apparatus of the present invention.

The continuous and direct flow of needle blanks from one set of dies to the next is best illustrated in FIGS. 12 through 16. As shown in FIG. 12, needle blanks work their way down through grooves 56 in hopper 50 and single needle blanks are deposited in each of lower die plate grooves 40. Lower die plate 30 is then positioned beneath upper die plate 32 which flat presses opposite sides of the needle blanks as shown in FIG. 13. As noted above, the needle blanks are then advanced to a position adjacent curving station 16 by lower die plate 30 wherein belt 72 draws the needles out of grooves 40 in die plate 30 and reciprocally curves them about mandrel 62 as shown in FIG. 14. After curving about mandrel 62, the needles are then rotated beneath mandrel 62 and deposited between side press die plates 94, 95, 96 and 97 as shown in FIG. 15. The needle blanks are then compressed between die plates 94, 95, 96 and 97 by means of ends 127 and 129 of rams 120 and 121 as shown in FIG. 16. After side pressing, the resulting needle blanks are curved and have a rectangular cross section thus forming curved rectangular bodied needles. And by side pressing and flat pressing the needle blanks to the same extent, a needle having a square cross-section may be obtained. An illustration of a curved rectangular bodied needle 200 formed by the needle forming apparatus 10 is best illustrated in FIG. 17.

It will be understood that various modifications can be made to the embodiments of the present invention herein disclosed without departing from the spirit and scope thereof. For example, various sizes of the instrument are contemplated, as well as various types of construction materials. Also, various modifications may be made in the configuration of the parts. Therefore, the above description should not be construed as limiting the invention but merely as exemplifications of preferred embodiments thereof. Those skilled in the art will envision other modifications within the scope and spirit of the present invention as defined by the claims appended hereto.

What is claimed is:

1. A method of forming curved rectangular bodied needles from substantially round-elongated needle blanks comprising the steps of:

a) flat pressing opposite sides of the needle blanks between a pair of flat press dies;

b) drawing the needle blanks from at least one of said flat press dies onto a rotatable mandrel;

c) curving the needle blanks between said rotatable mandrel and a reciprocable belt;

d) rotating the needle blanks about said mandrel and adjacent side press dies and depositing the needle blanks therebetween; and e) side pressing opposite sides of the needle blanks between said side press dies, said side pressing acting on sides of the needle blanks substantially perpendicular to the flat pressed sides.

2. The method according to claim 1, wherein said flat pressing step comprises:

a) positioning the needle blanks on a lower flat press die member;

b) advancing said lower die member adjacent an upper flat press die member;

c) compressing the needle blanks between said upper flat press die member and said lower flat press die member; and d) advancing said lower flat press die member adjacent said reciprocable belt.

3. The method according to claim 1, wherein said curving step comprises:

a) drawing the needle blanks from at least one of said flat press dies between said mandrel and said belt by advancement of said belt; and b) pressing said belt against the needle blanks and reciprocating said belt to form the needle blanks about said rotatable mandrel.

4. The method of claim 1, wherein said side pressing step comprises:

a) capturing the needle blanks between a plurality of adjacent die plates;

b) rotating said die plates between a pair of clamp members; and c) clamping said die plates about the needle blanks by squeezing said clamp members against said die plates.

* * * * *